US011359834B2

(12) United States Patent
Tomohito et al.

(10) Patent No.: US 11,359,834 B2
(45) Date of Patent: Jun. 14, 2022

(54) AIR CONDITIONER

(71) Applicant: Samsung Electronics Co., Ltd., Suwon-si (KR)

(72) Inventors: Ajiki Tomohito, Kanagawa (JP); Shinji Goto, Kanagawa (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/896,046

(22) Filed: Jun. 8, 2020

(65) Prior Publication Data

US 2020/0300501 A1 Sep. 24, 2020

Related U.S. Application Data

(63) Continuation of application No. 15/552,240, filed as application No. PCT/KR2015/011358 on Oct. 27, 2015, now Pat. No. 10,718,545.

(30) Foreign Application Priority Data

Feb. 18, 2015 (JP) ..... 2015-029165
Aug. 4, 2015 (JP) ..... 2015-154111
Sep. 22, 2015 (KR) ..... 10-2015-0133527

(51) Int. Cl.
*F24F 13/14* (2006.01)
*F24F 1/0014* (2019.01)
(Continued)

(52) U.S. Cl.
CPC ..... *F24F 13/1413* (2013.01); *F24F 1/0014* (2013.01); *F24F 1/0047* (2019.02);
(Continued)

(58) Field of Classification Search
CPC ..... F04D 25/088; F24F 2013/0616; F24F 2221/14; F24F 13/1413; F24F 13/142;
(Continued)

(56) References Cited

U.S. PATENT DOCUMENTS

2009/0241576 A1* 10/2009 Tsuji ..... F24F 13/14 62/259.1
2010/0192611 A1* 8/2010 Yamaguchi ..... F24F 13/14 62/291

(Continued)

FOREIGN PATENT DOCUMENTS

CN 101144633 A 3/2008
CN 103196181 A 7/2013

(Continued)

OTHER PUBLICATIONS

Chinese Office Action dated Nov. 13, 2020, in corresponding Chinese Patent Application No. 201580076563.1.

(Continued)

*Primary Examiner* — Vivek K Shirsat
*Assistant Examiner* — Ko-Wei Lin
(74) *Attorney, Agent, or Firm* — Staas & Halsey LLP

(57) ABSTRACT

Disclosed herein is an air conditioner capable of guiding air in a desired direction with an adjusted speed without marring the appearance to solve the above-described problems. An air conditioner comprising a ceiling-embedded type indoor unit configured to discharge air into an indoor room through an air outlet simultaneously sucking indoor air through an air inlet, wherein a air conditioner comprises, a main flap configured to guide a direction of air discharged from a air outlet in a preset direction, and a sub-flap configured to guide the direction of air between the main flap and the sub-flap in the preset direction, wherein a length of a main flap in a direction where air flows is longer than that of the sub-flap in the direction where air flows.

19 Claims, 10 Drawing Sheets

(51) Int. Cl.
*F24F 1/0047* (2019.01)
*F24F 13/02* (2006.01)

(52) U.S. Cl.
CPC ..... *F24F 13/0227* (2013.01); *F24F 13/142* (2013.01); *F24F 2013/1433* (2013.01); *F24F 2013/1446* (2013.01)

(58) Field of Classification Search
CPC .... F24F 13/0227; F24F 13/06; F24F 13/1426; F24F 13/10; F24F 13/075; F24F 13/072; F24F 13/068; F24F 11/79; F24F 7/10
USPC ..... 454/241, 248, 292, 284, 322, 317
See application file for complete search history.

(56) References Cited

U.S. PATENT DOCUMENTS

| | | | | |
|---|---|---|---|---|
| 2010/0210201 | A1 | 8/2010 | Dreisilker et al. | |
| 2012/0003917 | A1 | 1/2012 | Jeong | |
| 2012/0122389 | A1* | 5/2012 | Kishimoto | F24F 1/0076 454/284 |
| 2014/0138043 | A1* | 5/2014 | Matsumoto | F24F 1/0057 165/11.1 |
| 2014/0179214 | A1 | 6/2014 | Rinke et al. | |
| 2014/0227956 | A1 | 8/2014 | Steinert et al. | |
| 2015/0176850 | A1 | 6/2015 | Nakai et al. | |

FOREIGN PATENT DOCUMENTS

| | | | | | |
|---|---|---|---|---|---|
| CN | 203364364 | U | | 12/2013 | |
| CN | 203744487 | U | | 7/2014 | |
| JP | 1-170792 | | | 7/1989 | |
| JP | 4-136450 | U | | 12/1992 | |
| JP | 6-159786 | | | 6/1994 | |
| JP | 9-196459 | | | 7/1997 | |
| JP | 10132320 | A | | 5/1998 | |
| JP | 2000-9342 | A | | 1/2000 | |
| JP | 3069577 | B2 | | 7/2000 | |
| JP | 3302906 | B2 | | 7/2002 | |
| JP | 2009-52834 | A | | 3/2009 | |
| JP | 2010071499 | A | | 4/2010 | |
| JP | 2010101504 | A | | 5/2010 | |
| JP | 2013-44511 | | | 3/2013 | |
| JP | 2013050281 | A | * | 3/2013 | F24F 13/14 |
| JP | 2014-9918 | A | | 1/2014 | |
| JP | 2014-44039 | | | 3/2014 | |
| KR | 10-2005-0075832 | A | | 7/2005 | |
| KR | 10-2007-0019195 | A | | 2/2007 | |
| KR | 100728348 | B1 | | 6/2007 | |
| KR | 10-2008-0010682 | | | 1/2008 | |
| KR | 100898121 | B1 | | 5/2009 | |
| KR | 10-2014-0101286 | A | | 8/2014 | |

OTHER PUBLICATIONS

International Search Report dated Feb. 17, 2016 in connection with International Patent Application No. PCT/KR2015/011358.
Written Opinion of the International Searching Authority dated Feb. 17, 2016 in connection with International Patent Application No. PCT/KR2015/011358.
Office Action dated Apr. 20, 2020 in connection with Chinese Patent Application No. 201580076563.1, 16 pages.
Office Action dated Jul. 29, 2019 in connection with Chinese Patent Application No. 201580076563.1, 15 pages.
Office Action dated Jun. 19, 2020 in Japanese Application No. 2015-154111.
Office Action dated Jun. 25, 2020 in Japanese Application No. 2015-154111.
Office Action dated Dec. 5, 2019 in Japanese Application No. 2015-154111.
Office Action dated Oct. 28, 2021, in Korean Application No. 10-2015-0133527.
Notice of Allowance dated Apr. 26, 2022, in Korean Application No. 10-2015-0133527.

* cited by examiner

AIR CONDITIONER

CROSS-REFERENCE TO RELATED APPLICATIONS

The present application is a continuation of U.S. patent application Ser. No. 15/552,240 filed on Aug. 18, 2017, which is a 371 of International Patent Application No. PCT/KR2015/011358 filed on Oct. 27, 2015, which claims priority to Japanese Patent Application No. 2015-029165 filed on Feb. 18, 2015, Japanese Patent Application No. 2015-154111 filed on Aug. 4, 2015, and Korean Patent Application No. 10-2015-0133527 filed on Sep. 22, 2015, the disclosures of which are herein incorporated by reference in their entirety.

BACKGROUND

1. Field

The present invention relates to an air conditioner, and more particularly, to an air conditioner including a ceiling-embedded type indoor unit configured to discharge air into an indoor room through an air outlet simultaneously sucking indoor air through an air inlet.

2. Description of Related Art

In general, a ceiling-embedded type indoor unit includes a main flap and a sub-flap configured to control a direction and volume of air discharged into an indoor room.

Particularly, each of the flaps is rotatably installed at an air outlet, controlled to blow air to feet during a heating operation, and controlled to blow air in a lateral direction during a cooling operation such that the entire room is air-conditioned.

However, since the main flap and sub-flap described above are installed such that both flaps can be seen by a user, all parting lines are visible to the user marring the appearance.

SUMMARY

An aspect of the present disclosure is to provide an air conditioner capable of guiding air in a desired direction with an adjusted speed without marring the appearance to solve the above-described problems.

In accordance with an aspect of the disclosure, an air conditioner including a ceiling-embedded type indoor unit configured to discharge air into an indoor room through an air outlet simultaneously sucking indoor air through an air inlet, wherein the air conditioner include: a main flap configured to guide a direction of air discharged from the air outlet in a preset direction; and a sub-flap configured to guide the direction of air between the main flap and the sub-flap in the preset direction, wherein a length of the main flap in a direction where air flows is longer than that of the sub-flap in the direction where air flows.

The main flap include: a first guide part configured to guide air discharged from the air outlet downward; and a second guide part rotatably connected to the first guide part and configured to guide the air guided downward by the first guide part in a different direction.

The main flap extends downward from the air outlet.

A width of the second guide part is greater than that of the sub-flap.

The second guide part is disposed at an end of the first guide part.

As the sub-flap rotates about a rotation shaft installed at one end thereof, a distance between the other end thereof and the second guide part is changed.

A vertical length of the main flap is greater than that of the sub-flap.

The second guide part has a flow path forming surface formed on one surface thereof, the sub-flap has a flow path forming surface formed on a lower surface thereof, and an air flow path is formed between the flow path forming surface of the second guide part and the flow path forming surface of the sub-flap.

The rotation shaft of the second guide part is disposed at an upper end of the flow path forming surface of the second guide part, and the rotation shaft of the sub-flap is disposed at an upper end of the flow path forming surface of the sub-flap.

The air outlet has a rectangular shape, the main flap has a plate shape installed at the air outlet, and the sub-flap has a plate shape installed at the air outlet.

The second guide part has an elliptical shape.

The main flap is configured to surround the sub-flap when the second guide part rotates about the rotation shaft.

The main flap further include an elevating device to move up and down with respect to the air outlet.

The main flap include a first rotating device configured to rotate the second guide part.

The air conditioner including a second rotating device configured to rotate the sub-flap.

The main flap closes the air outlet simultaneously covering the sub-flap to be invisible in an operation stop state.

The air conditioner including a front panel provided with the air inlet and the air outlet, wherein an indoor side surface of the main flap is formed on the same plane as an indoor side surface of the front panel in an operation stop state.

The air conditioner according further including: a main flap driving device configured to rotate the main flap about a rotation shaft; and a sub-flap driving device disposed between the main flap driving device and the sub-flap and configured to rotate the sub-flap about another rotation shaft in linkage to rotational movement of the main flap.

The sub-flap driving device include a linking device disposed between the main flap and the sub-flap.

The main flap driving device raises and lowers the main flap between a closed position in which the air outlet is closed and an open position disposed at a lower position than the closed position in which the air outlet is open and rotates the main flap located at the open position about the rotation shaft.

According to the embodiments of the present disclosure, effects of guiding air in a desired direction with an adjusted speed may be obtained without marring designability.

In addition, effects of inhibiting so-called cold draft (downward flow of cold air) that is an unpleasant feeling caused during a cooling operation may be obtained by guiding most of conditioned air to flow in a lateral direction during the cooling operation by compressing an air outlet with a main flap and a sub-flap.

Also, effects of preventing dew condensation occurring on each flap may be obtained without marring the appearance by disposing a heat insulating member on upper surfaces of the main flap and the sub-flap in a state where the second guide part and the sub-flap rotate and the air is discharged in a lateral direction from the air outlet.

DETAILED DESCRIPTION

Hereinafter, embodiments of the present disclosure will be described in detail with reference to the accompanying drawings. Meanwhile, the terms used throughout the specification "front end", "rear end", "upper", "lower", "upper end", and lower end", and the like are defined based on the drawings and the shape and position of each element are not limited by these terms.

First Exemplary Embodiment

Hereinafter, a ceiling-embedded type indoor unit according to an embodiment of the present disclosure will be described with reference to the drawings.

Figure 1:
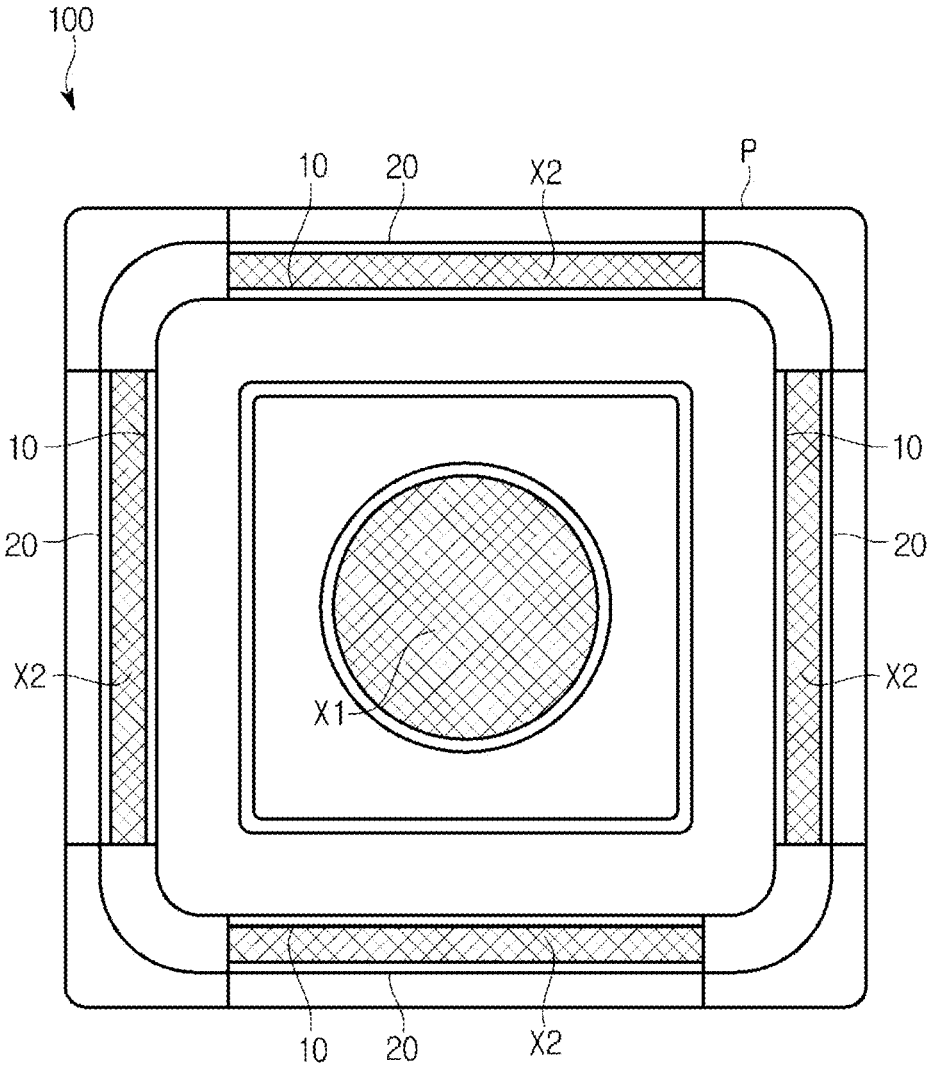
FIG. 1 is a view showing a ceiling-mounted indoor unit according to a first embodiment of the disclosure.

A ceiling-embedded type indoor unit 100 according to a first exemplary embodiment that is embedded in a recessed portion of a ceiling as shown in FIG. 1 sucks indoor air through an air inlet X1, exchanges heat with the sucked air, and discharges the heat-exchanged air into an indoor space via an air outlet X2 simultaneously. Particularly, the ceiling-embedded type indoor unit 100 includes a front panel P, a fan, a bell mouth, a heat-exchanger, a drain fan, and the like.

However, the fan, bell mouth, heat-exchanger, and drain fan are not illustrated herein.

In this regard, the front panel P is, for example, almost rectangular in a planar view. Although the front panel P having an air inlet X1 formed at the center and a plurality of air outlets X2 formed along each side of the front panel P is exemplarily illustrated according to the present embodiment, the concepts of the present disclosure are not limited thereto.

In addition, although the shapes of the air inlet X1 and the air outlets X2 are not particularly limited, the air inlet X1 has a nearly circular shape and each air outlet X2 has a nearly rectangular shape.

Figure 2:
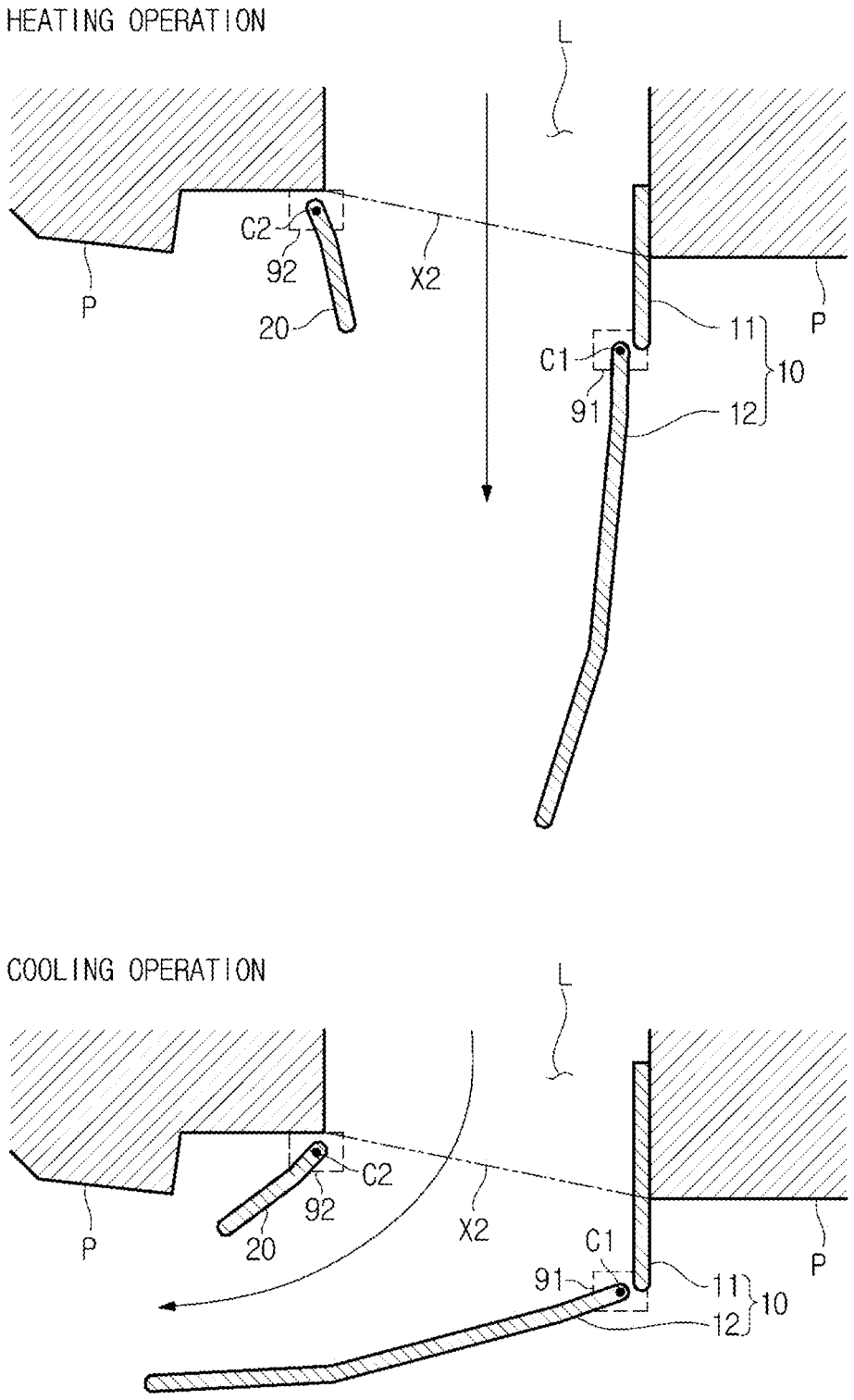
FIG. 2 is a view showing main flaps and sub flaps according to a first embodiment of the disclosure.

The air outlet X2 according to the present embodiment is formed to penetrate the front panel P as shown in FIG. 2 simultaneously constituting a lower end opening of a through-hole L through which air heat-exchanged by a heat-exchanger (not shown) flows.

The ceiling-embedded type indoor unit 100 according to the present embodiment includes a main flap 10 and a sub-flap 20 supported via, for example, gears and links, on inner surfaces (hereinafter, referred to as support surface 30) of the front panel P provided along short sides of each of the air outlets X2 and controls a direction and a speed of the air discharged through each of the air outlets X2 by using these flaps 10 and 20.

Hereinafter, the main flap 10 and the sub-flap 20 will be described.

The main flap 10 is provided to guide the air discharged from the air outlet X2 in a preset direction.

For example, as illustrated in FIG. 2, the flaps 10 and 20 extend downward to send the air to feet during a heating operation and extend laterally to perform air conditioning of the entire room during a cooling operation.

However, the above-described "preset direction" refers to, for example, a direction selected by a user, particularly, a direction selected from a downward direction perpendicular to the air outlet X2 and a lateral outward direction from the air outlet X2, i.e., an opposite direction to the air inlet X1.

Figure 3:
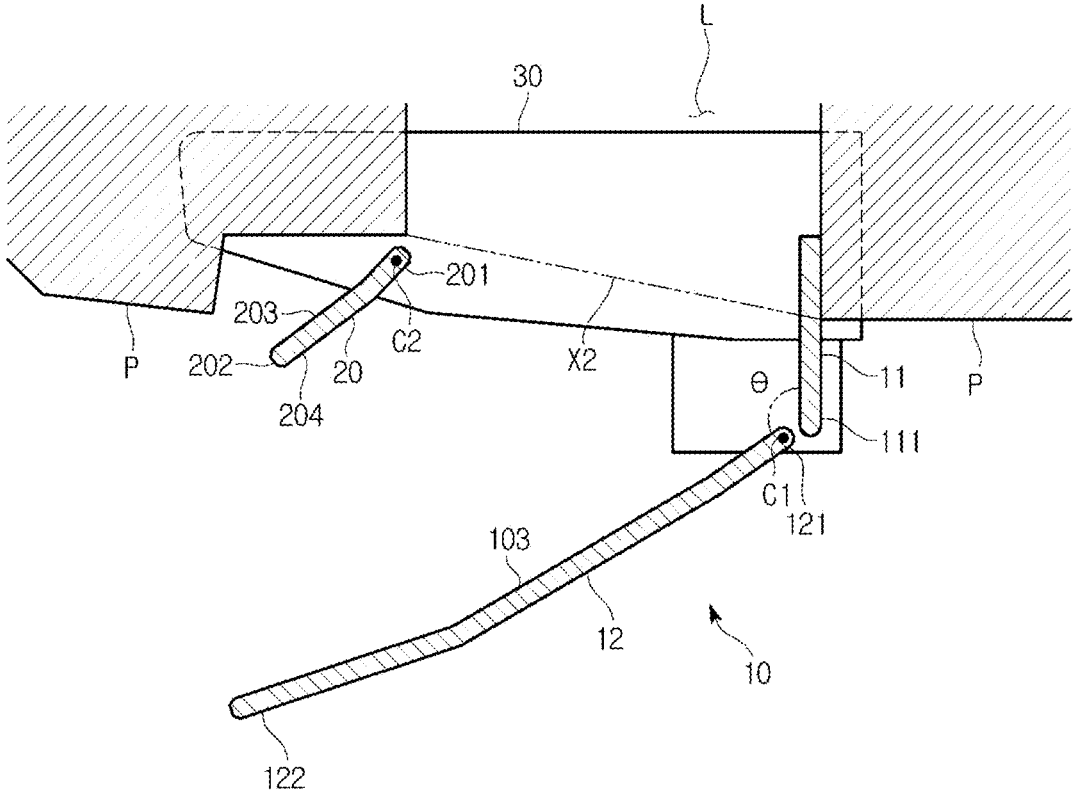
FIG. 3 is schematic configuration diagram of main flaps and sub flaps according to a first embodiment of the disclosure.

The main flap 10 according to the present embodiment is configured to be supported by the support surface 30 so as to move up and down and to change the direction of air discharged from the air outlet X2 toward a space below the air outlet X2 as illustrated in FIG. 3.

Particularly, the main flap 10 includes a first guide part 11 extending down from the air outlet X2 and a second guide part 12 extending from a lower end portion 111 of the first guide part 11.

The first guide part 11 guides air discharged from the air outlet X2 downward and may have, for example, a plate-shaped member supported by the support surface 30 so as to move up and down in this case.

More particularly, the first guide part 11 is formed to have a flat panel shape, be installed along one long side of the air outlet X2 (long side close to the air inlet X1 according to the present embodiment), and extends perpendicularly down from the air outlet X2.

The second guide part 12 changes the direction of air guided downward by the first guide part 11 and may be a plate-shaped member supported by the support surface 30 to extend from the lower end portion 111 of the first guide part 11 in this case. According to the present embodiment, the second guide part 12 is separately formed from the first guide part 11 configured to be raised and lowered in linkage to the first guide part 11.

More particularly, the second guide part 12 may be may extend in a curved form from the lower end portion 111 of the first guide part 11 in an airflow direction (preset direction).

The second guide part 12 according to the present embodiment guides the air guided downward by the first guide part 11 in the preset direction while rotating about the lower end portion 111 of the first guide part 11 as illustrated in FIG. 3.

More particularly, the second guide part 12 is configured to change an angle (θ) with the first guide part 11 as the second guide part 12 is supported so as to rotate about the lower end portion 111 of the first guide part 11 or a rotation shaft C1 installed in the vicinity thereof.

The main flap 10 may further include a first rotating device 91 configured to rotate the second guide part 12 about the rotation shaft (C1).

According to the present embodiment, the rotation shaft C1 is set at one end 121 of the second guide part 12 closer to the first guide part 11. As the second guide part 12 rotates about the one end 121, the other end 122 may be oriented in the preset direction.

That is, the rotation shaft C1 is installed at an upstream end of the second guide part 12, more particularly, is disposed at a closest position to the upstream end of a flow path forming surface 103 of the second guide part 12 that forms a flow path through which air flows. In other words, the rotation shaft C1 is installed such that a movement distance of the upstream end of the flow path forming surface 103 is the shortest when the second guide part 12 rotates.

According to the above-described configuration, the second guide part 12 of the main flap 10 may guide air guided downward by the first guide part 11 in the preset direction at a position after moving downward away from the air outlet X2.

The sub-flap 20 that compresses an airflow in accordance with a direction controlled by the above-described main flap 10 is a plate-shaped member installed along the other long side (long side opposite to the air inlet X1 according to the present embodiment) of the air outlet X2 in this case. More particularly, the sub-flap 20 is installed to face the main flap 10 at the other side of the air outlet X2 simultaneously being rotatably supported by the support surface 30 and constitutes a flow path through which air flows together with the main flap 10 as illustrated in FIG. 3.

More particularly, the sub-flap 20 is configured to rotate about a rotation shaft C2 installed at one end 201 supported by the support surface 30 and to change a distance between the other end 202 and the second guide part 12. That is, the rotation shaft C2 is installed at an upstream end of the sub-flap 20, more particularly, such that a distance from an upstream end of a flow path forming surface 204 of the sub-flap 20 constituting a flow path through which air flows is the shortest. In other words, the rotation shaft C2 is installed such that a movement distance of the upstream end of the flow path forming surface 204 is the shortest when the sub-flap 20 rotates.

The sub-flap 20 may further include a second rotating device 92 configured to rotate the sub-flap 20 about the rotation shaft C2.

According to the present embodiment, a length of the main flap 10 in the airflow direction is configured to be greater than that of the sub-flap 20 in the airflow direction.

More particularly, a length of the second guide part 12 of the main flap 10 in the airflow direction is configured to be greater than that of the sub-flap 20 in the airflow direction. That is, an area of the second guide part 12 of the main flap 10 in the airflow direction may be greater than that of the sub-flap 20 in the airflow direction.

In addition, a heat insulating member (not shown) is installed on each of the above-described main flap 10 and the sub-flap 20 according to the present embodiment.

The heat insulating member is disposed on a surface of the main flap 10 in contact with air discharged from the air outlet X2 (the above-described flow path forming surface 103) and a back surface 203 of the sub-flap 20 opposite to the surface (the above-described flow path forming surface 204) of the sub-flap 20 in contact with the air discharged from the air outlet X2.

In other words, the heat insulating member is disposed on upper surfaces of the main flap 10 and the sub-flap 20, i.e., surfaces of the main flap 10 and the sub-flap 20 invisible from the outside there below, while air discharged from the air outlet X2 flows in a lateral direction.

The ceiling-embedded type indoor unit 100 according to the present embodiment further includes the elevating device configured to raise and lower the main flap 10, the first rotating device 91 configured to rotate the second guide part 12, and the second rotating device 92 configured to rotate the sub-flap 20.

Hereinafter, operation of each of the flaps will be described while describing these devices.

Figure 4:
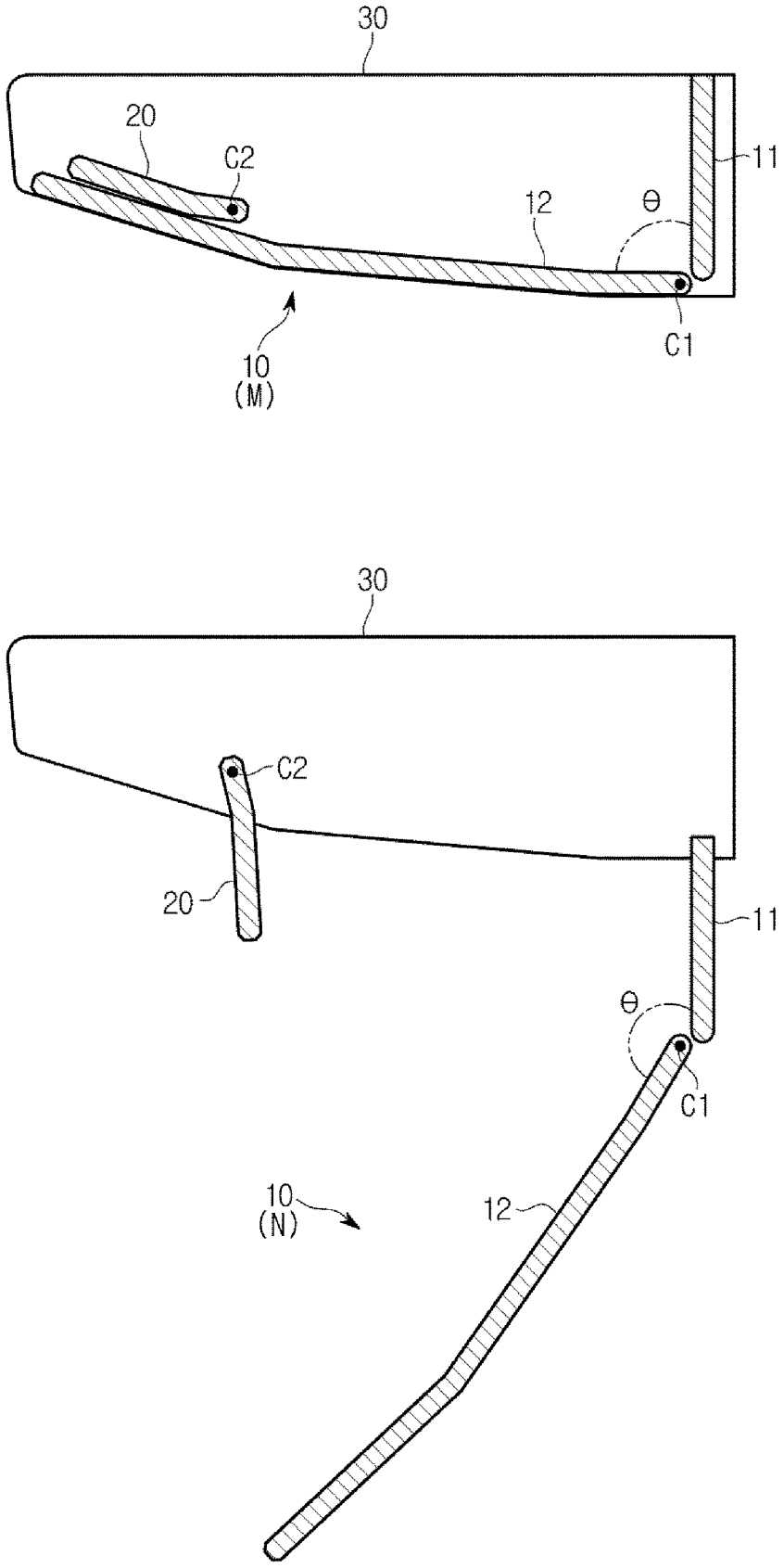
FIG. 4 is a view showing the operation of the main flap in the first embodiment.

The elevating device that raises and lowers the main flap 10 between an accommodation position M where wind direction controllers 11 and 12 are accommodated at upper positions than the air outlet X2 and a control position N where the wind direction controllers 11 and 12 control the direction of air discharged from the air outlet X2 at lower positions than the air outlet X2 as illustrated in FIG. 4 is configured to raise and lower the wind direction controllers 11 and 12 in linkage to each other, by using, for example, a rack and pinion in this case.

The first rotating device 91 that changes the angle (θ) between the wind direction controllers 11 and 12 by rotating the second guide part 12 may include, for example, a motor (not shown) connected to the rotation shaft C1 of the second guide part 12.

The first rotating device 91 according to the present embodiment is configured to receive a set wind direction signal indicating a direction of air discharged from the air outlet X2, i.e., a direction set by the user as described above, from a controller (not shown) and rotate the second guide part 12 by a predetermined angle in accordance with the set wind direction signal. Thus, the angle (θ) between the wind direction controllers 11 and 12 changes, for example, within a range of 90° to 180° so that the direction of air may be controlled in a preset direction.

In addition, while the above-described elevating device lowers the main flap 10 from the accommodation position M to the control position N, the first rotating device 91 rotates the second guide part 12 by a predetermined angle.

The second rotating device 92 that changes a distance between the other end 202 of the sub-flap 20 and the main flap 10 by rotating the sub-flap 20 may include, for example, a motor (not shown) connected to the rotation shaft C2 of the sub-flap 20, and the like.

A wind speed may be controlled in the preset direction as the second rotating device 92 changes a distance between the sub-flap 20 and the first guide part 11 or a distance between the sub-flap 20 and the second guide part 12. Thus, this configuration enables air conditioning of a wider area. In addition, since hot air may be supplied to the feet during a heating operation, a temperature difference between the top and bottom in a room caused by insufficient heating around the floor and density difference.

In addition, when the elevating device raises the main flap 10 to the accommodation position as described above, the second rotating device rotates the sub-flap 20 in a predetermined direction so as to be accommodated at an upper position than the air outlet X2 together with the main flap 10.

Since the length of the second guide part 12 in the airflow direction is greater than that of the sub-flap 20 in the ceiling-embedded type indoor unit 100 having the above-described configuration according to the present embodiment, the sub-flap 20 may be hidden by the main flap 10 such that the sub-flap 20 cannot be seen from the user in the case where the air is discharged in a lateral direction or the flaps 10 and 20 are accommodated at upper positions than the air outlet X2, and thus, designability may not deteriorate.

In addition, since the second guide part 12 is configured to change the distance between the sub-flap 20 and the second guide part 12 by rotating about the lower end portion 111 of the first guide part 11, air discharged from the air outlet X2 may be guided in the preset direction and compressed in the direction.

Accordingly, a pressure loss of air may be considerably reduced without undesirably compressing the airflow according to conventional methods, particularly, the speed of air discharged in the lateral direction may be increased. Furthermore, air-conditioning of the entire room may be possible.

In addition, since the main flap 10 is installed along one long side of the air outlet X2 and the sub-flap 20 is installed along the other long side of the air outlet X2, the air outlet X2 may be compressed by the flaps 10 and 20 and all air discharged through the air outlet X2 may be controlled.

Thus, most of the conditioned air may be guided in the lateral direction during the cooling operation and an uncomfortable feeling caused during the cooling operation, so-called, cold draft may be prevented.

Meanwhile, since an arrival distance of air may increase by compressing hot air by the main flap 10 and the sub-flap 20 during the heating operation, the feet may be sufficiently heated. Thus, an unpleasant feeling caused by a big temperature difference between the top and bottom of the room may be prevented.

In addition, since the rotation shaft C1 is installed at the upstream end of the second guide part 12 and the rotation shaft C2 is installed at the upstream end of the sub-flap 20, a cross-section of a flow path may be widened in comparison with conventional flow paths. Thus, the pressure loss may decrease, the comfort during the cooling and heating operations may be improved, and the designability may be maintained.

Dew condensation may be caused at a dew point by a temperature decrease in each of the flaps 10 and 20 due to heat conduction on non-design surfaces through which cool air passes. However, since the heat insulating member is disposed on the surfaces of the main flap 10 and the sub-flap 20 invisible from the outside there below, dew condensation may be prevented on the main flap 10 and the sub-flap 20 without marring the appearance. In addition, the present disclosure is not limited to the above-described embodiment. For example, although the first guide part and the second guide part are separate elements according to the above embodiment, the second guide part may also be connected to a lower end portion of the first guide part and rotate about the lower end portion as a central axis.

Also, although the first rotating device is configured to rotate the second guide part by a predetermined angle while the elevating device lowers the main flap from the accommodation position to the control position according to the present embodiment, the first rotating device may also rotate the second guide part by a predetermined angle after the elevating device lowers the main flap from the accommodation position to the control position.

Although the heat insulating member is disposed on the main flap and the sub-flap according to the present embodiment, dew condensation may be prevented on the flaps by applying a hollow structure to both flaps or one of the flaps.

Although the plurality of air outlets is formed along each side of the front panel having a nearly rectangular shape in a planar view according to the present embodiment, the number of the air outlets is not limited thereto and one or two air outlets may also be formed in the front panel.

In addition, there is no need to install the main flap and the sub-flap at all air outlets and the main flap and the sub-flap may be installed at some of the air outlets provided in the front panel such that air discharged through the air outlets is controlled.

Figure 5:
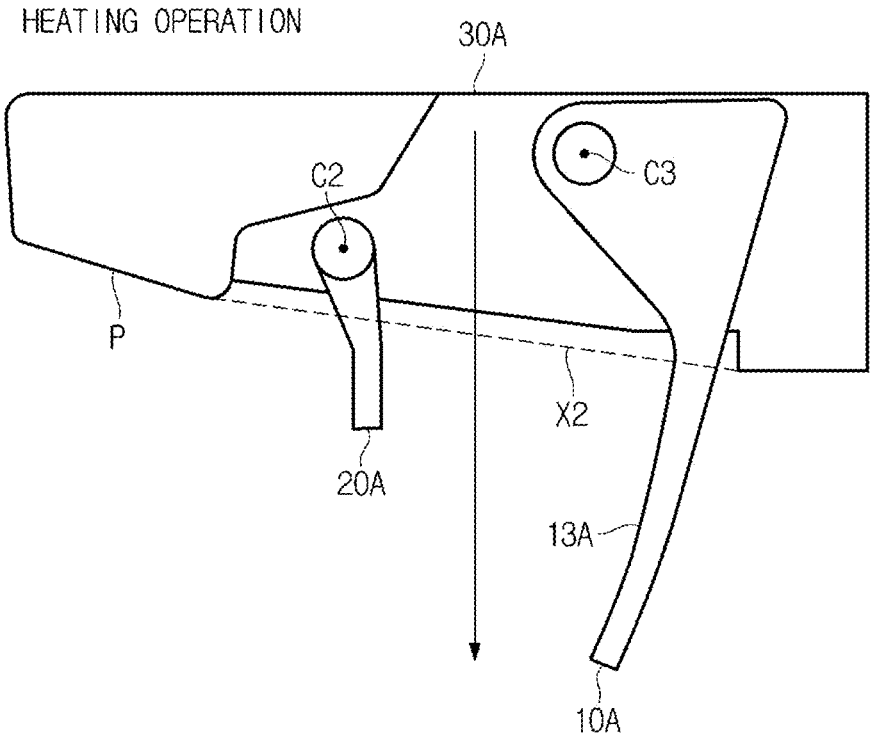
FIG. 5 is a view showing main flaps and sub flaps in the second embodiment.
Figure 5:
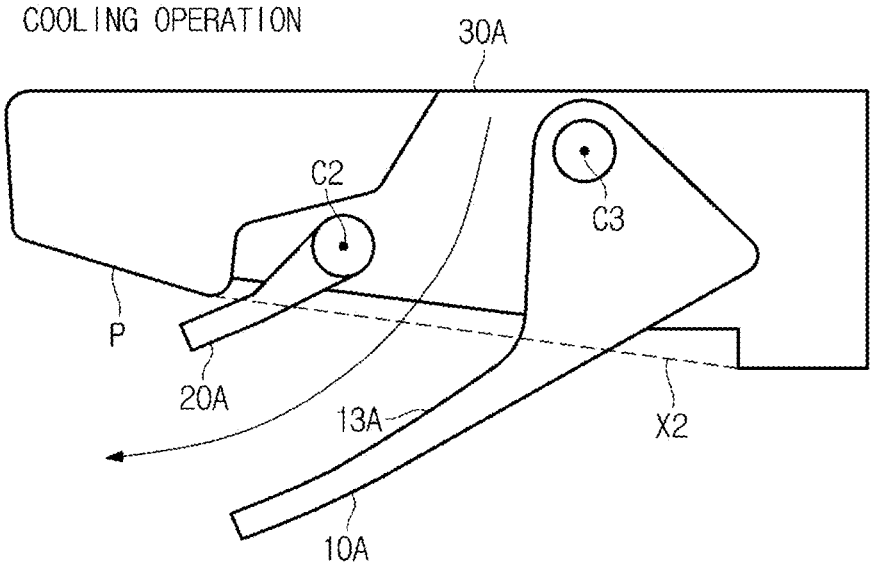

Although the main flap includes the first guide part and the second guide part separated from the first guide part and these wind direction controllers are configured to be raised and lowered in linkage to each other according to the present embodiment, a main flap 10A according to a second exemplary embodiment may also be configured to control the wind direction by a single guide part 13A as illustrated in FIG. 5.

The guide part 13A is configured to rotate about a rotation shaft C3 located at an upper position than the air outlet X2 without being raised or lowered in a different manner from the previous embodiment A sub-flap 20A that rotates about the rotation shaft C2 in the same manner as the previous embodiment is configured to change the distance from the guide part 13A.

Since the rotation shaft C3 of the guide part 13A is located at an upper position than the air outlet X2 in the above-described configuration, a length of the main flap 10 extending down from the air outlet X2 is shorter than that of the main flap according to the previous embodiment, thereby improving designability.

In addition, since the airflow may be compressed by the main flap 10A and the sub-flap 20A according to the above-described configuration, air may be guided in the preset direction with no decrease in speed of the air.

The present disclosure is not limited to the above-described embodiments and may be modified in various ways within the scope of the invention.

Figure 6:
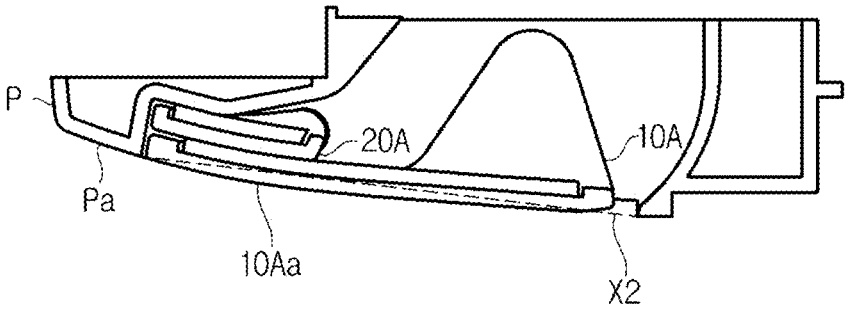
FIG. 6 is a view showing main flaps and sub flaps in the third embodiment.

In addition, it is preferable that the main flap 10A described above may overlap the sub-flap 20A such that the sub-flap 20A is not visible from an indoor room simultaneously closing and the air outlet X2 in an operation stop state where an air conditioning operation is stopped as illustrated in FIG. 6 according to a third exemplary embodiment.

In this case, an indoor side surface 10Aa of the main flap 10A is provided on the same plane as an indoor side surface Pa of the front panel P in the operation stop state. The indoor side surface 10Aa of the main flap 10A constitutes a part of the indoor side surface Pa of the front panel P in the operation stop state. More particularly, the front end portion (downstream portion) of the indoor side surface 10Aa of the main flap 10A is continuously formed with the air outlet X2 of the indoor side surface Pa of the front panel P in the operation stop state as illustrated in FIG. 6.

Since the rotation shaft C3 of a wind direction controller 13 is installed at an upper position than the air outlet X2 in the above-described configuration as illustrated in FIGS. 5 and 6, a length of the main flap 10 extending down from the air outlet X2 may be shorter than that of the main flap according to the previous embodiment during the heating operation, thereby improving designability.

Also, since the airflow may be compressed by the main flap 10A and the sub-flap 20A according to the above-described configuration, air may be guided in the preset direction with no decrease in speed of the air.

In addition, since the main flap 10A is configured such that the main flap 10A screens the sub-flap 20A to be invisible from the indoor room and the indoor side surface 10Aa of the main flap 10A constitutes a part of the indoor side surface Pa of the front panel P in the operation stop state, designability may not deteriorate.

Fourth Exemplary Embodiment

Hereinafter, a ceiling-embedded type indoor unit according to a fourth exemplary embodiment related to the present disclosure will be described in detail. However, the same reference numerals may be applied to the same elements as those according to the first to third exemplary embodiments and descriptions thereof may be omitted.

Although the first rotating device 91 configured to rotate the main flap and the second rotating device 92 configured to rotate the sub-flap, each including a motor (not shown), have been described above by way of example according to the first to third exemplary embodiments, a ceiling-embedded type indoor unit according to the fourth exemplary embodiment configured to drive the main flap and the sub-flap by using a single common motor will be described.

Hereinafter, driving devices of the flaps which are features of the fourth exemplary embodiment will be described in more detail.

Figure 7:
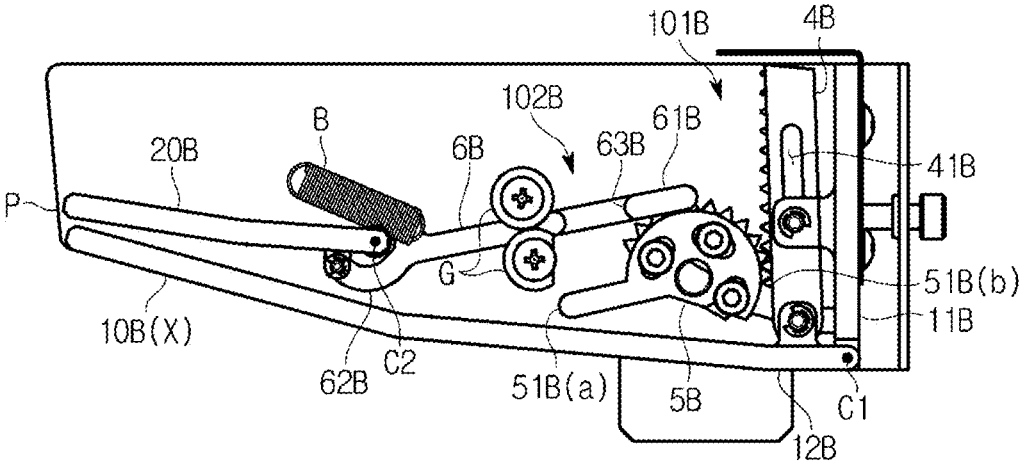
FIG. 7 is a view showing the main flap drive mechanism and the sub-flap drive mechanism in the fourth embodiment.
Figure 8:
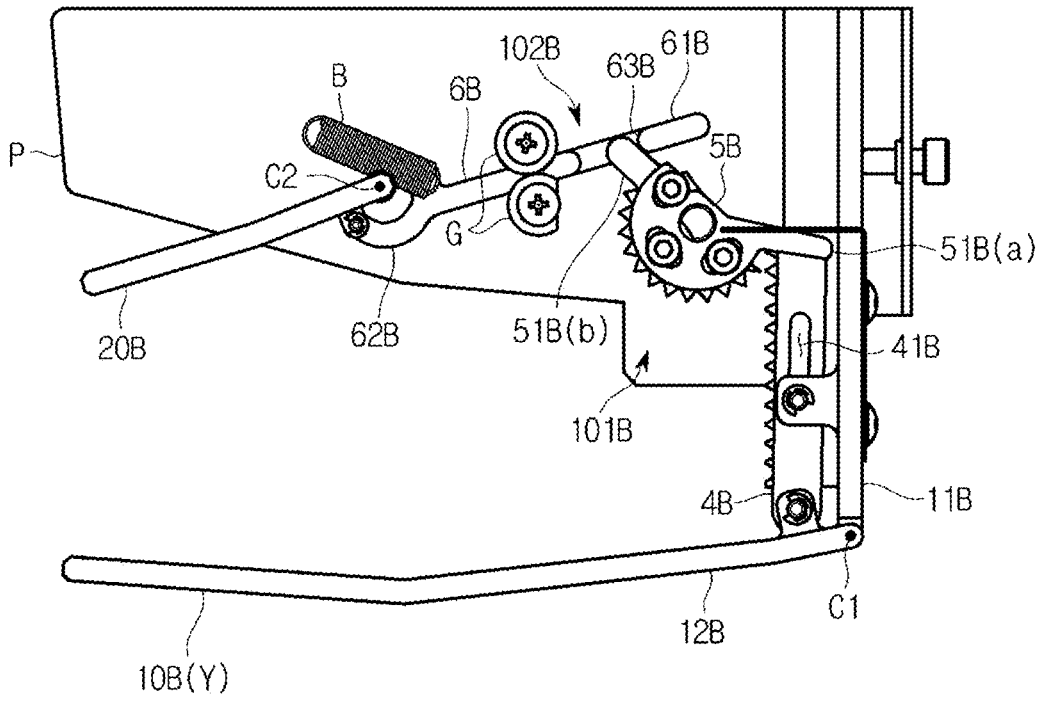
FIG. 8 is a view showing the main flap drive mechanism and the sub-flap drive mechanism in the fourth embodiment.
Figure 9:
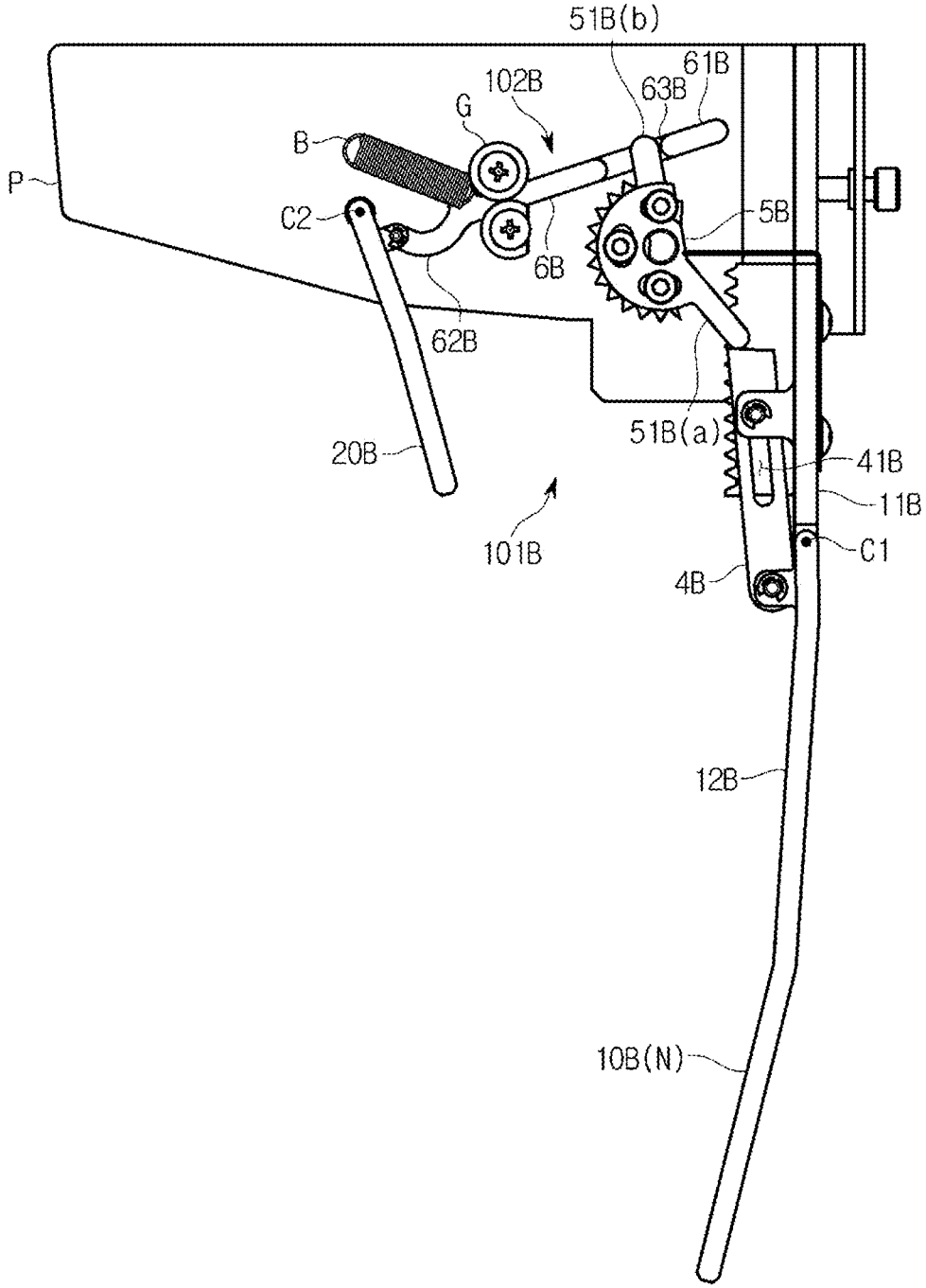
FIG. 9 is a view showing the main flap drive mechanism and the sub-flap drive mechanism in the fourth embodiment.

The ceiling-embedded type indoor unit according to the fourth exemplary embodiment includes a main flap driving device 101B configured to rotate a main flap 10B about a rotation shaft C1 and a sub-flap driving device 102B configured to rotate a sub-flap 20B about a rotation shaft C2 as illustrated in FIGS. 7 to 9.

The main flap driving device 101B raises and lowers the main flap 10B between a closed position X where the air outlet is closed and an open position Y located at a lower position than the closed position X where the air outlet is open and rotates the main flap 10B located at the open position Y about the rotation shaft C1. Here, the air outlet is formed at a position marked in FIG. 3 in the same manner as the first exemplary embodiment. The main flap driving device 101B according to the present embodiment includes a motor (not show, for example, a stepping motor) and uses a so-called rack and pinion that converts rotational movement of a driving shaft of the motor into linear movement.

Particularly, as illustrated in FIGS. 7 to 9, the main flap driving device 101B includes a slide member (rack) 4B mounted on the main flap 10B and provided with a plurality of gears along the vertical direction and a gear 5B connected to a driving axis of the motor (not shown) and engaged with the slide member 4B.

The slide member 4B that slides in the vertical direction in linkage to rotation of the gear 5B has a flat plate shape and includes a slide groove 41B formed along the vertical direction in this case.

A first guide part 11B is mounted on the slide member 4B via a bolt or the like inserted into the slide groove 41B, and the slide member 4B is configured to slide in the vertical direction along the first guide part 11B.

In addition, a second guide part 12B is mounted on a lower end portion of the slide member 4B. More particularly, the second guide part 12B, which is configured to be in contact with a downstream end of the first guide part 11B at an upstream end thereof and to rotate about the rotation shaft C1 installed at the upstream end, rotates about the rotation shaft C1 in linkage to slide movement of the slide member 4B.

However, the slide member 4C is provided with an elastic member (not shown) such as a spring to be elastically supported upward from a lower portion.

The gear 5B may include a plurality of gears installed along a circumferential direction and an extended portion 51B extending outward in a radial direction. Particularly, the gear 5B is, for example, a toothed gear provided with a plurality of gears in a portion along the circumferential direction and a pair of extended portions 51C (hereinafter referred to as one extended portion 51Ba and the other extended portion 51Bb to distinguish the respective extended portions 51C) are provided on the circumferentially outer sides of the gear. Particularly, the pair of extended portions 51B are configured such that one extended portion 51Ba is in contact with an upper end of the slide member 4B and the other extended portion 51Bb is in contact with a sub-flap driving device 12B, which will be described later, in a state where the gear 5B is not engaged with the slide member 4B.

The operation of the main flap 10B by the main flap driving device 101B configured as described above will be described.

As illustrated in FIG. 7, when the main flap 10B is located at the closed position X, the gear 5B and the slide member 4B are engaged with each other. When the motor is rotated, for example, in a forward direction in this state, the slide member 4B slides down in linkage to rotation of the gear 5B and the main flap 10B is lowered.

In addition, as illustrated in FIG. 8, when the main flap 10B arrives at the open position Y, the gear 5 and the slide member 4B are disengaged from each other and one extended portion 51Ba is brought into contact with an upper end of the slide member 4 at the same time.

When the motor is further rotated in the forward direction at the open position Y, the one extended portion 51Ba presses the slide member 4B downward such that the slide member 4B rotates the second guide part 12B about the rotation shaft C1 to move away from the air outlet.

In this case, the second guide part 12B rotates by a predetermined angle in accordance with, for example, a set wind direction signal input by the user, and arrives at the control position N as illustrated in FIG. 9.

Meanwhile, when the motor is rotated in the reverse direction at the control position N, the one extended portion 51Ba moves away from the slide member 4B in linkage to rotation of the gear 5B.

In this case, the slide member 4B moves upward by movement of the one extended portion 51Ba to be elastically supported upward from a lower portion by an elastic member (not shown).

Accordingly, the second guide part 12B is rotated about the rotation shaft C1 to arrive at the open position Y as the second guide part 12B is pulled by the slide member 4B to approach the air outlet. At this time, the gear 5B is engaged with the slide member 4B.

When the motor is further rotated in the reverse direction at the open position Y, the slide member 4B slides farther upward and the main flap 10B is raised to arrive at the closed position X in linkage to slide movement of the slide member 4B.

Next, the sub-flap driving device 102B will be described.

The sub-flap driving device 102B according to the present embodiment is disposed between the sub-flap 20B and the main flap driving device 101B and rotates the sub-flap 20B about the rotation shaft C2 in linkage to rotational movement of the main flap 10B.

More particularly, the sub-flap driving device 102B includes a link member 6B disposed between the sub-flap 20B and the main flap driving device 101B.

The link member 6B fitted to a pair of guides G is configured to move forward and backward along an elongation direction of the link member 6B, and, in this case, for example, is provided with an elastic member B such as a spring to be elastically supported from one end 61B toward the other end.

A locking part 63B protruding in a thickness direction is installed at the one end 61B of the link member 6B, and one extended portion 51Ba is in contact with the locking part 63B in a state where the gear 5B is not engaged with the slide member 4B.

The sub-flap 20B is rotatably mounted on the other end 62B of the link member 6B. Particularly, the sub-flap 20B is configured to rotate about the rotation shaft C2 installed at an upstream end mounted on the other end 62B of the link member 6B and rotates about the rotation shaft C2 in linkage to forward-backward movement of the link member 6B.

The operation of the sub-flap 20B by the sub-flap driving device 102B configured as described above will be described.

As illustrated in FIG. 7, when the main flap 10B is located at the closed position X, the sub-flap 20B is accommodated at an upper portion than the air outlet and screened by the main flap 10B not to be seen from the indoor room.

When the main flap 10B moves from the closed position X to the open position Y by the main flap driving device 101B, the gear 5B is disengaged from the slide member 4B and the other extended portion 51Bb is brought into contact with the locking part 63B as illustrated in FIG. 8.

When the motor is rotated in the forward direction in this state, the other extended portion 51Bb slidably move the link member 6B via the locking part 63B toward the one end 61B from the other end 62B by rotation of the gear 5B as illustrated in FIG. 9.

Thus, the sub-flap 20B rotates about the rotation shaft C2 to approach the main flap 10 (here, the first guide part 11B).

In this case, the sub-flap 20B rotates by a predetermined angle, for example, by the set wind direction signal input by the user in the same manner as the second guide part 12B.

Meanwhile, when the motor is rotated in the reverse direction in a state where the main flap 10B is located at the control position N, the other extended portion 51Bb moves away from the locking part 63 in linkage to rotation of the gear 5B.

In this case, since the sub-flap 20B is elastically supported by the elastic member B toward the other end 62B from the one end 61B, the sub-flap 20B rotates about the rotation shaft C2 to move away from the main flap 10B (here, the first guide part 11B) by the above-described movement of the other extended portion 51Bb.

As described above, the sub-flap 20B is configured to rotate about the rotation shaft C2 in linkage to forward-backward movement of the link member 6B performed by the other extended portion 51Bb installed at the gear 5B. That is, according to the present embodiment, the motor of the main flap driving device 101B is also used as a driving source of the sub-flap driving device 102B.

Since the main flap 10B and the sub-flap 20B are driven using a single common motor according to the ceiling-embedded type indoor unit configured as described above, the entire apparatus may become compact, thereby realizing efficient use of space and arranging more parts constituting an indoor unit in a limited space.

However, exemplary embodiments of driving of the main flap 10B and the sub-flap 20B by using the common motor are not limited to the present embodiment.

Figure 10:
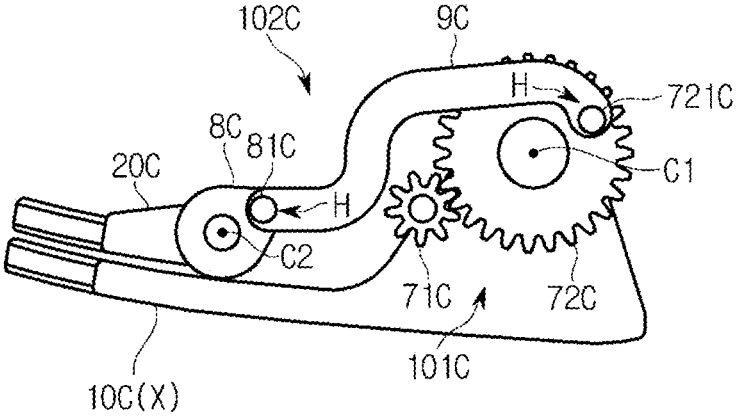
FIG. 10 is a view showing the main flap drive mechanism and the sub-flap drive mechanism in the fifth embodiment.
Figure 10:
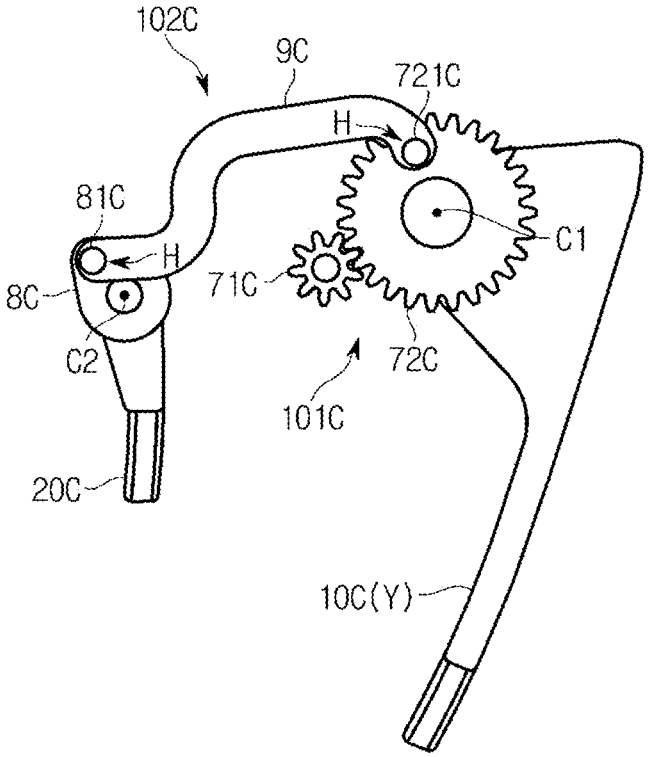

For example, as illustrated in FIG. 10, a main flap driving device 101C may rotate a main flap 10C about a rotation shaft C1 without raising and lowering the main flap 10C.

Particularly, the main flap driving device 101 includes a motor (not shown) and a plurality of gears 71C and 72C disposed between the motor and the main flap 10C.

In addition, a deceleration function of decelerating a rotation speed of the motor at a predetermined deceleration ratio in accordance with a gear ratio of the gears 71C and 72C and transmitting the rotation speed to the rotation shaft C1 of the main flap 10C is provided thereto. In this regard, the main flap driving device 101C includes a first gear 71C connected to a driving shaft of the motor and a second gear 72C engaged with the first gear 71C and connected to the rotation shaft C1 of the main flap 10C.

The main flap 10C rotatably moves about the rotation shaft C1 between the closed position X and the open position Y in linkage to forward and reverse rotation of the motor by the main flap driving device 101C away from the air outlet or toward the air outlet.

By using the above-described main flap driving device 101C, a simpler and easier configuration may be obtained and the entire apparatus may become more compact.

Meanwhile, a sub-flap driving device 102C may include a link member 9C, as a linking device, disposed between a sub-flap 20C and the main flap driving device 101C as illustrated in FIG. 10, More particularly, the sub-flap driving device 102C includes a cam 8C mounted on the rotation shaft C2 of the sub-flap 20C and a link member 9C connecting the cam 8C and the second gear 72C connected to the rotation shaft C1 of the main flap 10C.

The link member 9C has a plate shape installed from the rotation shaft C1 of the main flap 10C to the rotation shaft C2 of the sub-flap 20C and through holes H penetrating in a thickness direction are formed at one end of the main flap 10C and the other end of the sub-flap 20C.

A protrusion 721C such as a pin installed at the second gear 72C is fitted to the through hole H at the side of the main flap 10C, and a protrusion 81C such as a pin installed at the cam 8C is fitted to the through hole H at the side of the sub-flap 20C. Thus, the second gear 72C and the cam 8C are connected to each other via the link member 9C.

Since the cam 8C rotates in linkage to rotation of the second gear 72C by the link member 9C of the sub-flap driving device 102C configured as described above, the sub-flap 20C may be rotated about the rotation shaft C2 in linkage to rotational movement of the main flap 10C.

In addition, since mechanical strength of the sub-flap driving device 102C may be improved by increasing a diameter of each of the protrusions 721C and 81C, desired mechanical strength may be obtained without increasing the size of the entire link device and the entire apparatus may be more compact, Although the main flap driving device includes a motor according to the present embodiment, the sub-flap driving device may also include a motor to rotate the sub-flap about the rotation shaft, and the main flap driving device may also be configured to be disposed between the sub-flap driving device and the main flap and rotate the main flap about the rotation shaft in linkage to rotational movement of the sub-flap.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An air conditioner comprising:

an indoor unit including a front panel provided with an air inlet and an air outlet, the indoor unit being configured to suck indoor air through the air inlet and simultaneously discharge air through the air outlet, wherein the indoor unit includes a main flap, and a sub-flap, the main flap and the sub-flap are coupled to at least one motor so that the main flap and the sub-flap are rotatable simultaneously via the at least one motor, the main flap is rotatable about a first rotation axis and a second rotation axis spaced apart from each other to change a position of the main flap, and the sub-flap is rotatable about a third rotation axis, separated from the first rotation axis and the second rotation axis, to change a position of the sub-flap, to thereby guide the air discharged from the air outlet in a direction determined by the position of the main flap and the position of the sub-flap, and an indoor side surface of the main flap is positioned on substantially a same plane as an indoor side surface of the front panel in an operation stop state.

2. The air conditioner according to claim 1, wherein the third rotation axis is at one end of the sub-flap.

3. The air conditioner according to claim 2, wherein, as the sub-flap rotates about the third rotation axis, a distance between another end of the sub-flap and a point on the main flap is changed.

4. The air conditioner according to claim 1, wherein the indoor unit is embeddable in a ceiling and, while the indoor unit is embedded in the ceiling, the first rotation axis is positioned lower than the second rotation axis and the third rotation axis in a control position in which the main flap extends lower than the outlet and controls a direction of air discharged from the air outlet.

5. The air conditioner according to claim 1, wherein the indoor unit is embeddable in a ceiling and, while the indoor unit is embedded in the ceiling, the first rotation axis is positioned lower than the second rotation axis and the third rotation axis in a closed position in which the main flap closes the air outlet.

6. The air conditioner according to claim 1, wherein a length of the main flap in an airflow direction is longer than a length of the sub-flap in the airflow direction.

7. The air conditioner according to claim 1, wherein the indoor unit is embeddable in a ceiling of a room, and the main flap is configured to, while the indoor unit is embedded in the ceiling, close the air outlet while simultaneously covering the sub-flap so that the sub-flap is invisible from the room in the operation stop state.

8. The air conditioner according to claim 1, wherein:

the main flap includes a flow path forming surface formed on one surface of the main flap, the sub-flap includes a flow path forming surface formed on a lower surface of the sub-flap, an air flow path is formed so that the air discharged through the air outlet passes along the flow path forming surface of the main flap and the flow path forming surface of the sub-flap, and a length of the main flap in an airflow direction is longer than a length of the sub-flap in the airflow direction.

9. The air conditioner of claim 1, further comprising:

at least one link that couples the sub-flap and the main flap together, so that the sub-flap is rotatable about the third rotation axis in linkage with rotation of the main flap.

10. The air conditioner of claim 1, further comprising:

at least one link that couples the sub-flap and the main flap together, so that the sub-flap and the main flap are rotatable in linkage with each other via a same motor of the at least one motor.

11. The air conditioner of claim 1, wherein positions of the first rotation axis and the second rotation axis are movable to change the position of the main flap.

12. An air conditioner comprising:

an indoor unit including a front panel provided with an air inlet and an air outlet, the indoor unit being embeddable in a ceiling of a room and being configured to, while embedded in the ceiling, suck indoor air through the air inlet and simultaneously discharge air into the room through the air outlet, wherein the indoor unit includes a main flap rotatable about a first rotation axis and a second rotation axis spaced apart from each other to change a position of the main flap, a sub-flap rotatable about a third rotation axis, spaced apart from the first and second rotation axes, to change a position of the sub-flap, and at least one link that links the sub-flap and the main flap together, so that the sub-flap and the main flap are simultaneously rotatable in linkage with each other via a single motor to guide the air discharged from the air outlet in a direction determined by the position of the main flap and the position of the sub-flap, and an indoor side surface of the main flap is positioned on substantially a same plane as an indoor side surface of the front panel in an operation stop state.

13. The air conditioner of claim 12, wherein positions of the first rotation axis and the second rotation axis are movable to change the position of the main flap.

14. The air conditioner of claim 12, wherein the main flap is configured to close the air outlet while simultaneously covering the sub-flap so that the sub-flap is invisible from the room in the operation stop state.

15. An air conditioner comprising:

an indoor unit including a front panel provided with an air inlet and an air outlet, the indoor unit being embeddable in a ceiling of a room and being configured to, while embedded in the ceiling, suck indoor air through the air inlet and simultaneously discharge air into the room through the air outlet, wherein the indoor unit includes a main flap rotatable about a first rotation axis and a second rotation axis which are movable and separated from each other, to change a position of the main flap, a sub-flap rotatable about a third rotation axis to change a position of the sub-flap, and at least one link that links the sub-flap and main flap together, so that the sub-flap and the main flap are simultaneously rotatable in linkage with each other to guide the air discharged from the air outlet in a direction determined by the position of the main flap and the position of the sub-flap, and an indoor side surface of the main flap is positioned on substantially a same plane as an indoor side surface of the front panel in an operation stop state.

16. The air conditioner of claim 15, wherein the main flap is configured to close the air outlet while simultaneously covering the sub-flap so that the sub-flap is invisible from the room in the operation stop state.

17. The air conditioner of claim 15, wherein the sub-flap and the main flap are rotatable in linkage with each other via a single motor.

18. The air conditioner of claim 15, wherein positions of the first rotation axis and the second rotation axis are movable to change the position of the main flap.

19. An air conditioner comprising:

an indoor unit having air inlet and an air outlet, the indoor unit being configured to suck indoor air through the air inlet and simultaneously discharge air through the air outlet, wherein the indoor unit includes a main flap, and a sub-flap, the main flap and the sub-flap are coupled to at least one motor so that the main flap and the sub-flap are rotatable simultaneously via the at least one motor, the main flap is rotatable about a first rotation axis and a second rotation axis spaced apart from each other to change a position of the main flap, and the sub-flap is rotatable about a third rotation axis, separated from the first rotation axis and the second rotation axis, to change a position of the sub-flap, to thereby guide the air discharged from the air outlet in a direction determined by the position of the main flap and the position of the sub-flap, and the indoor unit is embeddable in a ceiling and, while the indoor unit is embedded in the ceiling, the first rotation axis is positioned lower than the second rotation axis and the third rotation axis in a closed position in which the main flap closes the air outlet.

* * * * *